US005885193A

United States Patent [19]

Habing et al.

[11] Patent Number: 5,885,193

[45] Date of Patent: Mar. 23, 1999

[54] BI-DIRECTIONAL EXERCISE RESISTANCE MECHANISM

[75] Inventors: Theodore G. Habing, Santa Ana; Douglas Habing, Long Beach; Ronald Gibson, Valecia, all of Calif.

[73] Assignee: Precor Incorporated, Bothell, Wash.

[21] Appl. No.: 44,555

[22] Filed: Mar. 19, 1998

Related U.S. Application Data

[60] Provisional application No. 60/039,357 Mar. 19, 1997.

[51] Int. Cl.[6] ..... A63B 21/00

[52] U.S. Cl. ..... 482/92; 482/99; 482/100; 482/137

[58] Field of Search ..... 482/94, 97, 98–103, 482/133, 136–138

[56] References Cited

U.S. PATENT DOCUMENTS 5,308,304 5/1994 Habing .
5,354,252 10/1994 Habing .
5,447,480 9/1995 Fulks .
5,468,202 11/1995 Habing .
5,549,530 8/1996 Fulks .

OTHER PUBLICATIONS

*Tuff Gym Series 150•250•450*, advertising brochure by TuffStuff.

*Primary Examiner*—John Mulcahy
*Attorney, Agent, or Firm*—Blakely, Sokoloff, Taylor & Zafman LLP

[57] ABSTRACT

A mechanism applies exercise resistance to a rotating member in both directions of rotation without a significant "dead zone" surrounding the neutral position. A cam is rotatably mounted to the frame of an exercise machine. A flexible member, which may be a belt, cable, chain or the like, is attached to a peripheral surface of the cam and is loaded by the exercise weights or other source of exercise resistance. The flexible member is guided around a pulley mounted on an arm that is pivotally attached to the cam so as to maintain the flexible member in close proximity to the peripheral surface of the cam. A pair of stops act on the arm to engage the arm for rotation with the cam in one direction and to prevent rotation of the arm with the cam in the opposite direction.

19 Claims, 2 Drawing Sheets

BI-DIRECTIONAL EXERCISE RESISTANCE MECHANISM

BACKGROUND OF THE INVENTION

1. Related Application

This application claims the benefit of co-pending provisional application Serial No. 60/039,357 filed Mar. 19, 1997.

2. Field of the Invention

This invention relates to the field of exercise equipment, and particularly to a mechanism for providing exercise resistance at a rotary actuator in both directions of rotation.

3. Prior Art

Various physical exercises require that exercise resistance be applied in opposite directions from a neutral position. A particular type of exercise machine requiring such application of exercise resistance is the type commonly referred to as a "multi-hip" machine for performing hip abduction, hip adduction, hip flexion and hip extension exercises. Examples of this type of machine are shown in commonly owned U.S. Pat. Nos. 5,308,304; 5,354,252; and 5,468,202. In these machines, exercise resistance is provided by a selectable weight stack coupled through a cable and pulley system to a rotary cam. A cushioned pad is coupled to the cam for performing the various hip exercises. As the cam is rotated in either direction from a neutral position, a cable is wound on the cam surface to cause the selected portion of the weight stack to be lifted. In these and similar prior art exercise machines, there is a substantial range of motion of the cam about the neutral position in which the cable is not in contact with the cam surface. Thus, the profile of the cam surface has no effect on the amount of the exercise resistance within this range of motion. This "dead zone" on either side of the neutral position detracts from the effectiveness of the exercise.

SUMMARY OF THE INVENTION

The present invention provides a mechanism to apply exercise resistance to a rotating member in both directions of rotation without a significant "dead zone" surrounding the neutral position. A cam is rotatably mounted to the frame of an exercise machine. A flexible member, which may be a belt, cable, chain or the like, is attached to a peripheral surface of the cam and is loaded by the exercise weights or other source of exercise resistance. The flexible member is guided around a pulley mounted on an arm that is pivotally attached to the cam so as to maintain the flexible member in close proximity to the peripheral surface of the cam. A pair of stops act on the arm to engage the arm for rotation with the cam in one direction and to prevent rotation of the arm with the cam in the opposite direction.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
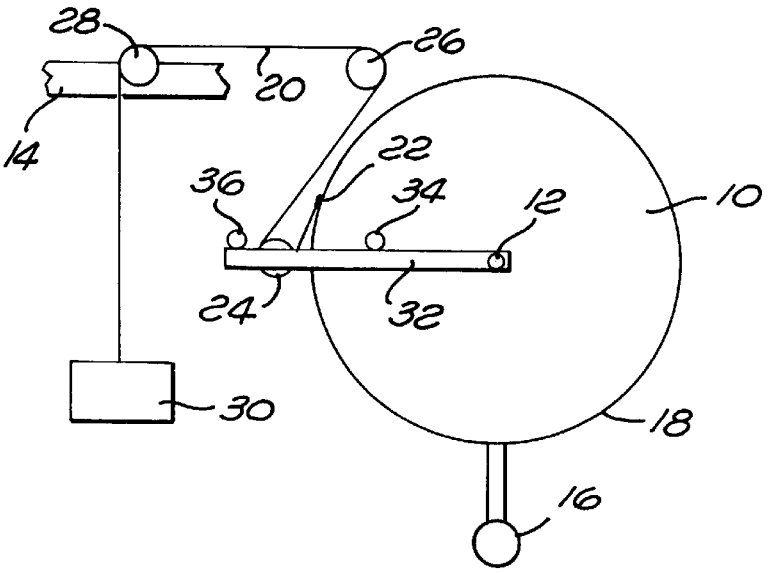
FIG. 1 is a schematic illustration of an embodiment of the present invention with the cam in a neutral position.

FIG. 1 schematically illustrates an exercise machine employing the present invention. Cam 10 is mounted for rotation about axis 12 on a fixed frame of the apparatus, shown in part here as 14. An exercise member 16, such as a cushioned pad for performing hip exercises, is coupled to cam 10. Cam 10 has a peripheral surface 18 shown here as having a generally circular shape. A flexible member 20 is attached to the peripheral surface 18 at 22. In a preferred embodiment of the invention, flexible member 20 is a flat, fiber-reinforced synthetic rubber belt. Other types of flexible members may be used to transmit the exercise resistance. For example, flexible member 20 may also comprise a braided cable or a chain.

Flexible member 20 is guided around pulley 24 and then around pulley 26. As shown in FIG. 1, flexible member 20 is then guided around pulley 28 and is coupled to weights 30. In various types of exercise machines, flexible member 20 may be guided by additional pulleys and coupled to additional exercise members. Furthermore, flexible member 20 may be guided by devices other than pulleys. Other suitable guides may be used as are appropriate for the type of flexible member employed, such as sprockets for a chain. Regardless of the specific configuration of the exercise machine, flexible member 20 is appropriately loaded by the source of exercise resistance, which may be weights as shown in FIG. 1, or may be any other source of exercise resistance as is well known to practitioners in the art.

Pulley 26 is mounted for rotation on fixed frame 14. However, pulley 24 is rotatably mounted on arm 32, which in turn is mounted for pivotal movement about axis 12. A stop 34 is mounted on cam 10 for operative engagement with arm 32 as described below. Another stop 36 is mounted on the fixed frame 14, also for operative engagement with arm 32 as described below. As shown in FIG. 1, cam 10 is in a neutral position, which is to say that cam 10 is not being acted upon by weights 30 to rotate in either the clockwise or counterclockwise direction.

Figure 2:
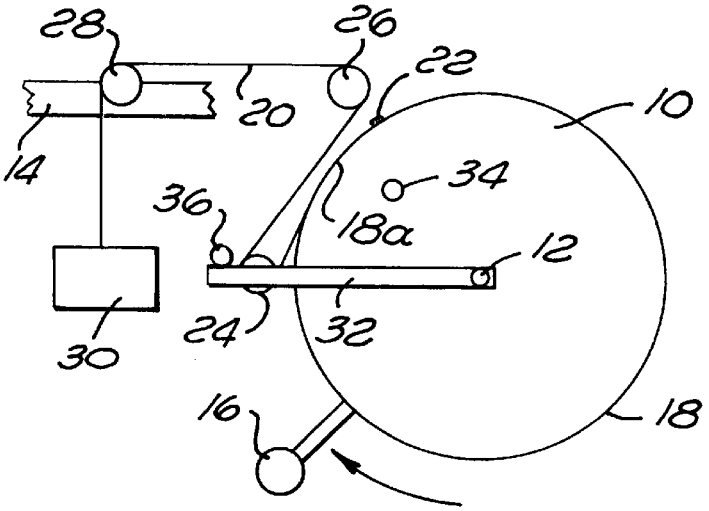
FIG. 2 illustrates the mechanism of FIG. 1 with the cam rotated in a first direction.

Referring now to FIG. 2, cam 10 is shown after rotation in a clockwise direction by an operator exerting an exercise force against exercise member 16. Rotation of the cam 10 causes flexible member 20 to be wound on portion 18*a* of peripheral surface 18 since arm 32, and hence pulley 24, are prevented from rotating with cam 10 by stop 36. Weights 30 are thus lifted to exert resistance against the operator's rotation of cam 10.

Figure 3:
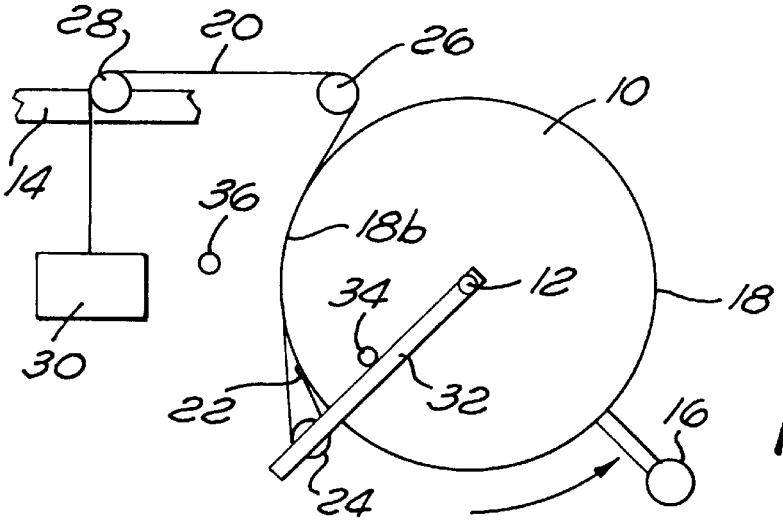
FIG. 3 illustrates the mechanism of FIG. 1 with the cam rotated in a second direction.

Referring next to FIG. 3, cam 10 is shown rotated in a counterclockwise direction from the neutral position. In this case, stop 34 bears against arm 32 so that the arm and pulley 24 are rotated in unison with cam 10. This causes flexible member 20 to be wound on portion 18*b* of peripheral surface 18, thereby again lifting the weights 30.

Figure 4:
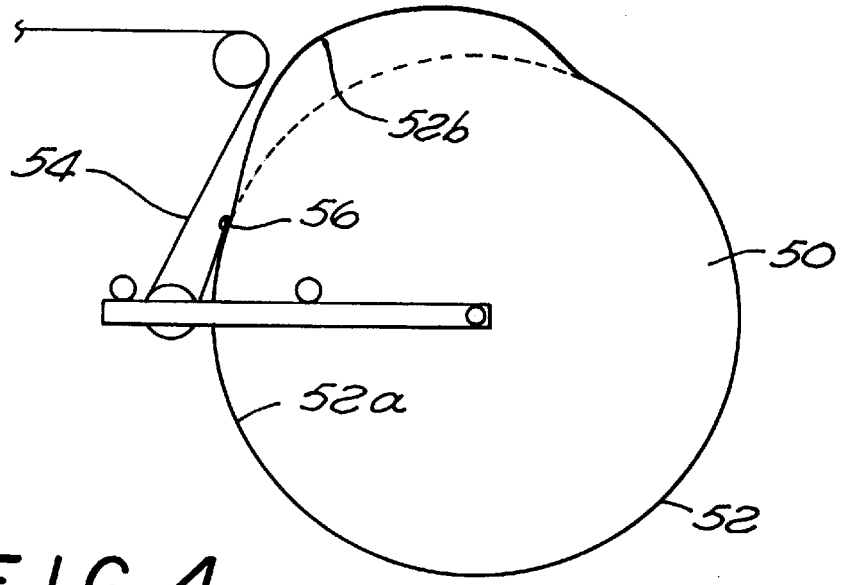
FIG. 4 illustrates a cam profile for providing different exercise resistance profiles in opposite directions of rotation.

Cam 10 is shown in FIGS. 1–3 as having a generally circular profile. However, it should be understood that the exercise resistance as a function of cam rotation can be tailored in either direction by altering the cam profile and the distance of pulley 26 from peripheral surface 18. In a multi-hip exerciser, it is desirable to have identical exercise resistance profiles in each direction of rotation. Thus, a generally circular cam profile is used, and pulley 26 is positioned to maintain flexible member 20 as close to peripheral surface 18 as possible. In other types of exercisers, it may be desirable to have non-circular cam profiles and to have different cam profiles on each side of the neutral position as illustrated in FIG. 4. Cam 50 is shown with different cam profiles in portions 52*a* and 52*b* of peripheral surface 52 on opposite sides of the point of attachment 56 of flexible member 54.

Figure 5:
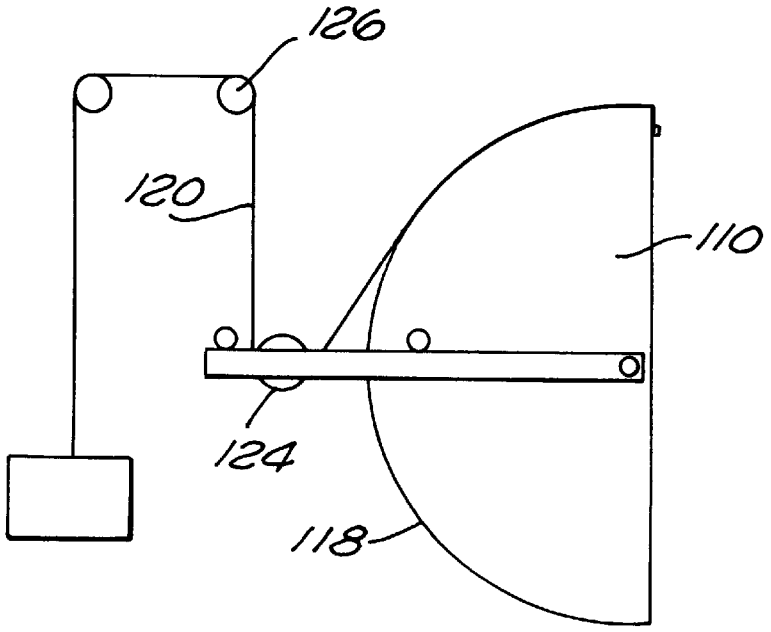
FIG. 5 is a schematic illustration of a second embodiment of the present invention.

A somewhat different embodiment of the invention is illustrated in FIG. 5. Here, cam 110 has a generally semi-circular peripheral surface 118. Idler pulley 126 is relatively distant from peripheral surface 118 so that the cam profile influences the exercise resistance in only one direction of rotation. As cam 110 rotates in a clockwise direction, flexible member 120 is wound on the peripheral surface 118. However, when cam 110 rotates in a counterclockwise direction, the portion of flexible member 120 between pulleys 124 and 126 does not come into contact with the cam.

Although the present invention has been described generally in terms of a multi-hip exerciser, it is to be understood that the present invention is not limited in this regard and may be applied to a variety of other types of physical exercise devices in which bi-directional exercise resistance is desirable. For example, the present invention may be advantageously employed in a leg extension/leg curl exerciser.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An exercise machine comprising:

a frame;

a resistance control member rotatably mounted on the frame;

a resistance communication member having one end thereof secured to the resistance control member, said resistance communication member loaded by a source of exercise resistance;

an arm pivotally coupled to the resistance control member;

a guide mounted on the arm, said resistance communication member trained around the guide;

a first stop coupled to the resistance control member to engage the arm for coordinated rotation with the resistance control member when the resistance control member rotates in a first direction away from a neutral position;

a second stop coupled to the frame to engage the arm so as to prevent rotation of the arm in a second direction when the resistance control member rotates in the second direction away from the neutral position; and whereby rotation of the resistance control member in either the first or second direction away from the neutral position is resisted by the source of exercise resistance acting through the resistance communication member.

2. The device of claim 1 wherein the resistance control member comprises a cam.

3. The device of claim 2 wherein the cam includes a peripheral surface to which the resistance communication member is secured.

4. The device of claim 3 wherein a first portion of the peripheral surface of the cam adjacent on a first side to the resistance communication member has a profile that is different from a second portion of the peripheral surface of the cam adjacent on a second side to the resistance communication member.

5. The device of claim 1 wherein said resistance communication member comprises a belt.

6. The device of claim 1 wherein said resistance communication member comprises a cable.

7. The device of claim 1 wherein said resistance communication member comprises a chain.

8. The device of claim 1 wherein the source of exercise resistance comprises a weight.

9. The device of claim 1 wherein the guide comprises a pulley rotatably mounted on the arm.

10. An exercise machine comprising:

a frame;

a source of exercise resistance;

a resistance control member rotatably mounted on the frame;

an exercise member coupled to the resistance control member;

a resistance communication member having one end thereof secured to the resistance control member and further coupled to the source of exercise resistance;

an arm pivotally coupled to the resistance control member;

a guide mounted on the arm, said resistance communication member trained around the guide;

a first stop coupled to the resistance control member to engage the arm for coordinated rotation with the resistance control member when the resistance control member rotates in a first direction away from a neutral position;

a second stop coupled to the frame to engage the arm so as to prevent rotation of the arm in a second direction when the resistance control member rotates in the second direction away from the neutral position; and whereby rotation of the resistance control member in either the first or second direction away from the neutral position is resisted by the source of exercise resistance acting through the resistance communication member.

11. The device of claim 10 wherein the exercise member is coupled to the resistance control member for simultaneous rotation therewith.

12. The device of claim 10 wherein the resistance control member comprises a cam.

13. The device of claim 12 wherein the cam includes a peripheral surface to which the resistance communication member is secured.

14. The device of claim 13 wherein a first portion of the peripheral surface of the cam adjacent on a first side to the resistance communication member has a profile that is different from a second portion of the peripheral surface of the cam adjacent on a second side to the resistance communication member.

15. The device of claim 10 wherein said resistance communication member comprises a belt.

16. The device of claim 10 wherein said resistance communication member comprises a cable.

17. The device of claim 10 wherein said resistance communication member comprises a chain.

18. The device of claim 10 wherein the source of exercise resistance comprises a weight.

19. The device of claim 10 wherein the guide comprises a pulley rotatably mounted on the arm.

* * * * *

UNITED STATES PATENT AND TRADEMARK OFFICE

CERTIFICATE OF CORRECTION

PATENT NO. : 5,885,193

DATED : March 23, 1999

INVENTOR(S) : Habing et al.

It is certified that error appears in the above-identified patent and that said Letters Patent is hereby corrected as shown below:

At item [75] Inventors, line 3, delete "Valecia" and insert -- Valencia --.

Signed and Sealed this

Twenty-fifth Day of July, 2000

*Attest:*

*Attesting Officer*

Q. TODD DICKINSON

*Director of Patents and Trademarks*